US007158042B2

(12) United States Patent
Lederer

(10) Patent No.: US 7,158,042 B2
(45) Date of Patent: Jan. 2, 2007

(54) VOLTAGE REGULATOR FOR PHYSICALLY REMOTE LOADS

(75) Inventor: Stephan Lederer, Hallerndorf (DE)

(73) Assignee: Siemens Aktiengesellschaft, Munich (DE)

( * ) Notice: Subject to any disclaimer, the term of this patent is extended or adjusted under 35 U.S.C. 154(b) by 132 days.

(21) Appl. No.: 10/961,744

(22) Filed: Oct. 8, 2004

(65) Prior Publication Data

US 2005/0088162 A1 Apr. 28, 2005

(30) Foreign Application Priority Data

Oct. 9, 2003 (DE) ..... 103 46 965

(51) Int. Cl.
*G08B 21/00* (2006.01)

(52) U.S. Cl. ..... 340/660; 323/281; 330/297

(58) Field of Classification Search ..... 340/660, 340/661, 693.1, 693.4, 870.39; 323/281; 330/297; 700/297, 298
See application file for complete search history.

(56) References Cited

U.S. PATENT DOCUMENTS 3,916,381 A * 10/1975 Johnson et al. ..... 379/28
4,367,437 A * 1/1983 Mikami ..... 323/349
4,413,250 A * 11/1983 Porter et al. ..... 340/538.11
4,916,643 A 4/1990 Ziegler et al.
5,117,175 A * 5/1992 Pettigrew et al. ..... 323/256
5,485,077 A 1/1996 Werrbach
5,610,504 A * 3/1997 Tsugita ..... 323/283
5,648,766 A * 7/1997 Stengel et al. ..... 340/870.39
6,081,161 A * 6/2000 Dacus et al. ..... 330/297
6,549,867 B1 * 4/2003 Smith ..... 702/107
6,900,697 B1 * 5/2005 Doyle et al. ..... 330/297

FOREIGN PATENT DOCUMENTS

DE 102 54 181 B3 1/2004
EP 0 284 106 B1 9/1988

OTHER PUBLICATIONS

U. Tietze, C. Schenk, "Halbleiter-Schaltungstechnik", Revised Edition, 1986, p. 529, Springer-Verlag, Germany.

* cited by examiner

*Primary Examiner*—John Tweel, Jr.

(57) ABSTRACT

The invention relates to a voltage regulator for physically remote loads (2) with an adjustable power supply (9) for the load (2), with a measurement device (11, 12) assigned to the load (2) for creating a digital measurement signal, which is transmitted over a digital data channel (13) arranged between a data source (15) and a data sink (17) to a setting device (18 to 20) for the power supply (9).

11 Claims, 1 Drawing Sheet

VOLTAGE REGULATOR FOR PHYSICALLY REMOTE LOADS

CROSS REFERENCE TO RELATED APPLICATIONS

This application claims priority to the German application No. 10346965.6, filed Oct. 9, 2003 and which is incorporated by reference herein in its entirety.

FIELD OF INVENTION

The invention relates to a voltage regulator for physically remote loads with an adjustable power supply for the loads, with a measuring device and with a control device for the power supply.

BACKGROUND OF INVENTION

As a related condition for the object of the invention the normal implementation of arranging the regulator at the load is to be dispensed in order to avoid the additional power losses or faults which occur there when a linear regulator or switched-mode regulator is used. Thus the object is achieved by a regulator with sensor lines.

In the book "Halbleiter-Schaltungstechnik" ("Semiconductor Circuit Technology"), by U. Tietze and Ch. Schenk, 8th revised edition 1986, a voltage regulator with sensor connections is described on page 529. In this case the voltage at a load arranged at a physically remote location is kept constant by a voltage regulator. So that the voltage drop at the resistors of the lines can be taken into account, sensor connections are provided at the load which are connected to the voltage regulator via sensor lines to measure the voltage.

FIG. 1 reproduces this type of voltage regulator 1 for a physically remote load 2 with a load resistor 3. The load 2 is connected via lines with line resistors 4 as well as the sensor lines 5 to the voltage regulator 1. The voltage regulator 1 features a constant voltage source 6 which is connected to the non-inverting input of an operational amplifier (OP) 7. The center of the voltage divider 8 connected to the sensor lines 5 is connect ed to the inverting input of the operational amplifier 7. The output of the operational amplifier 7 is connected to a voltage source 9 which can be regulated for example through a transistor for setting the voltage for the load 2.

SUMMARY OF INVENTION

Via the two sensor lines 5 the voltage is transferred in the same way from the load 2 to the voltage regulator 1. This means that, especially with long lines, faults can be detected on the sensor lines 5 which have an adverse effect on the voltage regulator 1.

For this reason it was suggested in the older patent application 102 36 166.5 that only one sensor line be used between load and voltage regulator, via which a measurement signal is transmitted quasi digitally, i.e. with an analog signal with different states, to a setting device for the power supply.

SUMMARY OF THE INVENTION

An underlying object of the invention is to embody a voltage regulator of the type mentioned at the start which does without additional lines for transmission of the measured voltage while being highly immune to interference.

The object is achieved in accordance with the invention by the claims. The voltage is thus recorded at the load. The deviation between the actual voltage and the required voltage is delivered over an available data channel as a digital signal to the adjustable voltage source which is adjusted accordingly, so that a constant voltage is present at the load.

It has proved advantageous for the measurement device to feature a compactor which compares the voltage present at the load with the voltage of a reference voltage source.

In accordance with the invention the coupling in the data channel can be undertaken by a mixing device being connected to the measurement device which features an input for the data signal of the data source and an output for a data channel and mixes the data signal with the measurement signal for transmission over the one data channel.

Advantageously the setting device for the power supply can feature an inverting OP amplifier which affects the actuator of the adjustable power supply.

A clean separation of the measurement signal from the data signal can occur if a decoder is connected at the input of the setting device which features an input for the data channel and an output for the data signal of a data sink and separates the measurement signal from the data signal.

BRIEF DESCRIPTION OF THE DRAWINGS

The invention is explained below in greater detail on the basis of the exemplary embodiments shown in the drawing. The diagrams show.

DETAILED DESCRIPTION OF INVENTION

Figure 1:
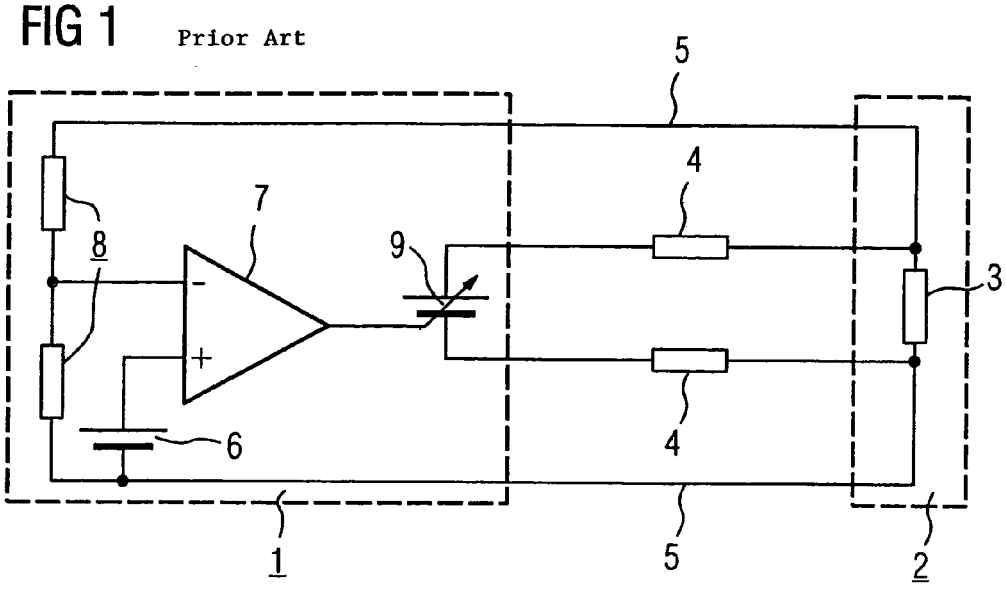
FIG 1 Prior Art
FIG. 1 a voltage regulator according to the prior art.
Figure 2:
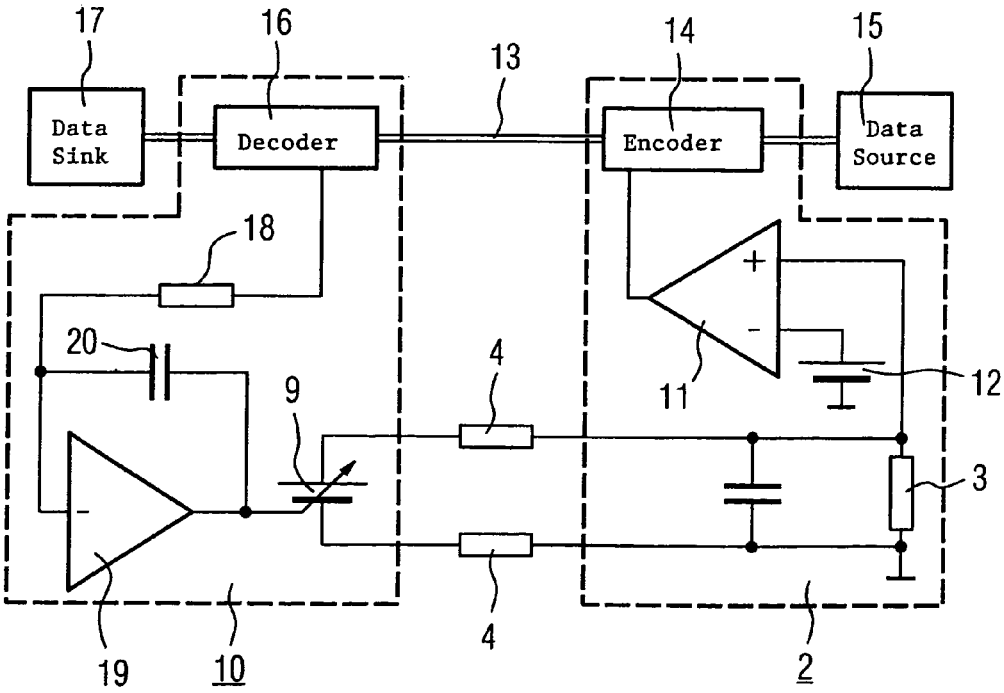
FIG. 2 a voltage regulator in accordance with the invention.

FIG. 2 illustrates the voltage regulator in accordance with the invention. A regulatable voltage source 9 arranged in the voltage regulator in accordance with the invention 10 is connected via connecting lines with the line resistors 4 to the load 2. At the load resistor 3 of the load 2 the voltage is tapped off and fed to the non-inverting input of an OP amplifier 11 assigned to the load 2, while a constant reference voltage source 12 is present at the inverting input. The OP amplifier 11 thus operates as a comparator. The signal of the output of the OP amplifier 11 is transmitted over an existing data channel 13, for example the data bus of a television camera. This is done by connecting the output of the OP amplifier 11 to an encoder 14, which is connected to a data source 15, for example a read-out circuit of a CCD camera. In the encoder 14 the output signal of the OP amplifier 11 is digitized and mixed with the digital output signal of the data source 15. The combined digital signal transmitted over the data channel 13 is fed to a decoder 16 which feeds the digital output signal of the data source 15 to a data sink 17, for example an image system. At the same time the decoder 16 causes a separation of the digital output signal of the OP amplifier 11 and its conversion into an analog signal, which is fed via a resistor 18 to the input of a inverting OP amplifier 19 which has feedback connection via a capacitor 20. The output of the inverting OP amplifier 19 is connected to the controller of the regulatable voltage source 9.

Through the arrangement in accordance with the invention the voltage in the load is recorded, in which the deviation is delivered as a digital signal via a data channel 13 to the regulatable voltage source 9 which is adjusted accordingly, so that a constant voltage is present at load 2.

The sensor signal for this is mixed into the data stream from the data source 15 to the data sink 17 by means of an encoder 14 and extracted again by a decoder 16. Encoder 14 and decoder 16 are to be seen here as logical blocks; To makes matters simpler they can also be physically integrated into the data source 15 and sink 17.

The advantages of voltage regulation for remote loads in accordance with the invention lies in the fact that no sensor lines are needed, since the sense signal is present digitally as a count value and can thus be transmitted via an existing data channel and the setting is made digitally. This means that the effort of filtering of the sensor lines as with the conventional solution is needed, so that a high immunity to interference is produced. Compared to the known solution, in which although the closed loop controller is arranged in the voltage regulator, two lines are still needed, the invention saves two lines. By contrast with the alternative known solution of arranging the controller at load 2, additional power losses and faults at the load are avoided. The faults are even additionally filtered through the long cable run. The reference means that high levels of accuracy are obtained. The residual ripple is kept low by matching the speed of regulation and load capacities.

It is thus important for the controller not to be arranged at the load, for the actual measurement of the voltage to be undertaken close to the load and for the comparison result to be transferred digitally to the voltage regulator 10 via an already available data channel 13 used for other purposes.

The invention claimed is:

1. A voltage regulator for regulating voltage in a remote load, comprising:

an adjustable power supply for providing power to the load;

a measuring device for measuring an electrical quantity of the load and generating a corresponding digital signal;

a data channel arranged between a data source and a data receiver; and a control device for adjusting the power supply, wherein the digital signal is transmitted over the data channel from the measuring device to the control device.

2. The voltage regulator according to claim 1, wherein the electrical quantity is a voltage of the load.

3. The voltage regulator according to claim 2, further comprising a comparator for comparing the voltage of the load to a further voltage of a reference voltage source.

4. The voltage regulator according to claim 3, wherein the measuring device comprises the comparator.

5. The voltage regulator according to claim 1, further comprising a digital adding device connected to the measuring device, the adding device having an input for a data signal originating from the data source and an output for connecting the adding device to the data channel, wherein the adding device processes a composition signal by merging the digital signal with the data signal.

6. The voltage regulator according to claim 1, wherein the control device comprises an integrator for adjusting the power supply.

7. The voltage regulator according to claim 5, further comprising a decoder connected to an input of the control device, the decoder having an input for connecting the data channel to the decoder and an output for connecting the decoder to the data receiver, wherein the decoder is adapted to obtain the digital signal from the composition signal.

8. A method of regulating the voltage of a remote load, comprising:

measuring an electrical quantity of the load;

generating a digital signal corresponding to the electrical quantity;

transmitting the digital signal over a data channel to a control device for adjusting a power supply for providing power to the load; and adjusting the power supply based on the transmitted digital signal by the control device.

9. The method according to claim 8, wherein the digital signal is transmitted over a data channel arranged between a data source and a data receiver.

10. The method according to claim 9, wherein a data signal originating from the data source and the digital signal are merged into a composition signal transmitted to the data receiver.

11. The method according to claim 10, wherein the composition signal is filtered by a decoder for obtaining the digital signal from the composition signal.

* * * * *